US005231422A

United States Patent [19]

Takeuchi et al.

[11] Patent Number: 5,231,422

[45] Date of Patent: Jul. 27, 1993

[54] RECORDING HEAD HAVING TWO SUBSTRATES SUPERPOSED SUCH THAT ELECTRODE SUPPORTING SURFACE OF ONE OF THE SUBSTRATES FACES NON-ELECTRODE-SUPPORTING SURFACE OF THE OTHER SUBSTRATE

[75] Inventors: Yukihisa Takeuchi, Aichi; Toshikazu Hirota, Nagoya, both of Japan

[73] Assignee: NGK Insulators, Ltd., Japan

[21] Appl. No.: 694,495

[22] Filed: May 2, 1991

[30] Foreign Application Priority Data

May 16, 1990 [JP] Japan ..... 2-126247

[51] Int. Cl.[5] ..... B41J 2/395

[52] U.S. Cl. ..... 346/76 PH; 346/139 C; 346/155

[58] Field of Search ..... 346/76 PH, 139 C, 155

[56] References Cited

U.S. PATENT DOCUMENTS

| | | |
|---|---|---|
| 3,124,804 | 3/1964 | Johnson et al. . |
| 3,968,500 | 7/1976 | Meisel et al. . |
| 4,082,619 | 4/1978 | Dehnert . |
| 4,300,146 | 11/1981 | Gustin et al. . |
| 4,595,823 | 6/1986 | Sorimachi et al. . |
| 4,612,433 | 9/1986 | Nagaoka et al. . |
| 4,684,960 | 4/1987 | Nishiwaki . |
| 4,961,078 | 10/1990 | Takeuchi et al. . |
| 4,965,589 | 10/1990 | Takeuchi et al. . |
| 4,973,982 | 11/1990 | Nakai et al. . |
| 4,990,934 | 2/1991 | Takeuchi et al. . |

FOREIGN PATENT DOCUMENTS

| | | |
|---|---|---|
| 0145942 | 6/1985 | European Pat. Off. . |
| 0150579 | 8/1985 | European Pat. Off. . |
| 0342995 | 11/1989 | European Pat. Off. . |
| 0372896 | 6/1990 | European Pat. Off. . |
| 3008498 | 3/1980 | Fed. Rep. of Germany . |
| 3435999A1 | 3/1984 | Fed. Rep. of Germany . |
| 3447581A1 | 4/1984 | Fed. Rep. of Germany . |
| 54-141140 | 11/1979 | Japan . |
| 58-12790 | 1/1983 | Japan . |

(List continued on next page.)

OTHER PUBLICATIONS

Patent Abstracts of Japan, vol. 10, No. 163 (M-487)(2219), 11 Jun. 1986; and JP-A-61016859 (Ricoh K.K.) 24 Jan. 1986.

Patent Abstracts of Japan, vol. 9, No. 223 (M-411)(1946), 10 Sep. 1985; and JP-A-60079959 (Matsushima) 7 May 1985.

Patent Abstract of Japan, vol. 9, No. 223.

Patent Abstract of Japan, vol. 9, No. 213.

Patent Abstract of Japan, vol. 10, No. 163.

Patent Abstract of Japan, vol. 11, No. 316.

Patent Abstract of Japan, vol. 12, No. 109.

"Nobel Metal Resistive Ribbon Electrode" IBM Technical Disclosure Bulletin, vol. 27, No. 12, May 1985.

"Silicon-Based Printhead Design" IBM Technical Disclosure Bulletin, vol. 22, No. 12, May 1985.

*Primary Examiner*—Benjamin R. Fuller
*Assistant Examiner*—Huan Tran
*Attorney, Agent, or Firm*—Parkhrust, Wendel & Rossi

[57] ABSTRACT

A recording head operable to apply an electric current to an electrically resistive layer, the head including two substrates each of which supports at least one electrode on one of opposite major surfaces thereof. At least one of the two substrates has an electrically insulating property and a lower wear resistance than the electrode(s) and each of the at least one substrate has a proximal portion, and a distal end portion extending from the proximal portion by a predetermined distance from the proximal portion for contact with said electrically resistive layer. The distal end portion has a thickness smaller than that of the proximal portion, as measured in a direction perpendicular to a direction of extension of the distal end portion. The two substrates are superposed on each other such that a non-electrode-supporting one of the opposite major surfaces of one of the two substrates faces an electrode-supporting one of the opposite major surfaces of the other substrate.

11 Claims, 2 Drawing Sheets

FOREIGN PATENT DOCUMENTS

| | | |
|---|---|---|
| 58-104787 | 6/1983 | Japan . |
| 59-169872 | 9/1984 | Japan . |
| 60-78772 | 5/1985 | Japan . |
| 60-174664 | 9/1985 | Japan . |
| 60-199669 | 10/1985 | Japan . |
| 61-35972 | 2/1986 | Japan . |
| 61-37493 | 2/1986 | Japan . |
| 61-230966 | 10/1986 | Japan . |
| 62-99162 | 5/1987 | Japan . |
| 62-161555 | 9/1987 | Japan . |
| 62-238767 | 10/1987 | Japan . |
| 62-292461 | 12/1987 | Japan . |
| 63-30279 | 2/1988 | Japan . |
| 63-87264 | 4/1988 | Japan . |
| 63-160855 | 7/1988 | Japan . |
| 2059352A | 4/1981 | United Kingdom . |
| 2101935A | 1/1983 | United Kingdom . |

RECORDING HEAD HAVING TWO SUBSTRATES SUPERPOSED SUCH THAT ELECTRODE SUPPORTING SURFACE OF ONE OF THE SUBSTRATES FACES NON-ELECTRODE-SUPPORTING SURFACE OF THE OTHER SUBSTRATE

BACKGROUND OF THE INVENTION

1. Field of the Invention

This invention relates in general to a recording head for recording or printing images such as characters and graphical representations, by applying an electric current to a recording medium or a ribbon or film or other form of intermediate member interposed between the recording medium and the recording head. More particularly, the present invention is concerned with the construction of a distal end portion of such a recording head at which the head contacts the recording medium or intermediate member.

2. Discussion of the Prior Art

Various types of recording heads for recording by application of an electric current to a recording medium or an intermediate member are known. In particular, there is known a recording head having a laminar or multi-layered structure which includes a substrate or substrates, and an array of recording electrodes and an array of return circuit electrodes which are supported by or formed on the substrate or substrates. Examples of this type of recording head are disclosed in laid-open Publication Nos. 61-35972, 62-292461, 54-141140, 58-12790 and 61-230966 of unexamined Japanese Patent Applications.

As disclosed in the publications identified above, the recording head of the type indicated above is adapted such that an electric current is applied to an electrically resistive or conductive layer formed or coated on or carried by a suitable recording medium or a suitable planar intermediate support member in the form of a sheet, film or ribbon. The electrically resistive or conductive layer may be formed on a roller or other support member, or constitute an inner layer of the recording medium or support member. In a recording operation using an intermediate ribbon or film having an electrically resistive layer and an ink layer, for example, an electric current is applied to the resistive layer through the recording head and causes Joule heat to be generated by the resistive layer. Selected local areas of the ink layer are then heated, and the ink material in these heated local areas is fused, vaporized or diffused. As a result, the ink material is transferred to the appropriate local areas of the recording medium so as to form a black or colored image. If a electric current is applied directly to a recording medium, the appropriate local areas of the medium are suitably colored due to Joule heat generated by an electric current, or due to removal of the covering material from the medium surface due to an electrical discharge occurring thereon.

The electrically resistive layer provided on the recording medium or intermediate support member may be an electrically conductive layer, an electrically conductive or resistive ink layer (which serves also as an ink-bearing layer), a heat-sensitive layer having an electrolyte, or any form of layer through which an electric current may flow.

In a recording or printing operation by the recording head for use with the recording medium or intermediate support member as described above, the recording electrodes and the return circuit electrode or electrodes must be held in electric contact with the electrically resistive layer of the recording medium or support member. To this end, the electrodes used in the known recording heads as disclosed in the publications indicated above are formed of a material which has a higher degree of wear resistance than the material of the substrate structure and the material of an electrically insulating layer used for the heads.

However, the mere selection of the materials suitable for the electrodes, substrate structure and insulating layer is not sufficient for maintaining good electrical contact of the electrodes with the electrically resistive layer for a prolonged period of time. As the accumulative operating time of the recording head increases, one of the recording electrode array and the return circuit electrode array is worn to a greater extent than the other electrode array, causing poor electrical contact of that electrode array with the electrically resistive layer, or separation of the electrode array from the substrate due to friction therebetween. Thus, it is difficult to maintain good electrical contact between the electrodes and the resistive layer, for a sufficiently long period.

For the recording head to maintain excellent operating characteristics with minimum crosstalk and to improve the print quality, it is required that the distance between the recording electrodes and the return circuit electrodes be kept small and constant. If an electrically insulating layer interposed between the two electrode arrays has a relatively small thickness to satisfy the above requirement, it is extremely difficult to form such an insulating layer or control its thickness, when the recording head is fabricated. Further, the insulating layer having a small thickness may result in reducing the mechanical strength of the recording head. For this reason, the above approach to assure excellent operating characteristics of the recording head is not practically available.

Another approach that can be considered to assure excellent operating characteristics of the recording head is to use two substrates which support respective arrays of electrodes, i.e., recording electrodes and return circuit electrodes. These two substrates are bonded together by an adhesive with an electrically insulating layer interposed between the major surfaces of the two substrates on which are formed the electrode arrays. This laminar structure, however, must include two adhesive layers, one between the insulating layer and the first substrate, and the other between the insulating layer and the second substrate. The adhesive layers tend to have different thickness values, depending upon the amount of an adhesive agent applied or the specific manner of application of the adhesive agent. Further, the thickness of each adhesive layer tends to vary from one portion of the layer to another. Accordingly, it is difficult to accurately control the distance between the recording and return circuit electrodes, and is therefore difficult to improve the printing quality attained by the recording head.

SUMMARY OF THE INVENTION

It is therefore an object of the present invention to provide a recording head for recording by application of an electric current to a recording medium or an intermediate member interposed between the head and the medium, which recording head assures excellent electrical contact of the electrodes with the medium or intermediate member, with a constant distance kept between the recording and return circuit electrodes, to permit a high-quality recording operation, for a prolonged period of use, while at the same time has a sufficient overall mechanical strength.

The above object may be attained according to the principle of the present invention, which provides a recording head operable to apply an electric current to an electrically resistive layer provided on a recording medium or a planar intermediate member interposed between the medium and the recording head, comprising two substrates, and at least one electrode formed on one of opposite major surfaces of each of the two substrates, the two substrates and the electrodes being adapted to be held, at a distal end of the recording head, in contact with the electrically resistive layer, wherein at least one of the two substrates has an electrically insulating property and a lower wear resistance than the at least one electrode formed on the at least one substrate, and each of the at least one substrate has a proximal portion, and a distal end portion extending from the proximal portion by a predetermined distance from the proximal portion for contact with the electrically resistive layer. The distal end portion has a thickness smaller than that of the proximal portion, as measured in a direction perpendicular to a direction of extension of the distal end portion. Further, the two substrates are superposed on each other such that a non-electrode-supporting surface of one of the opposite major surfaces of one of the two substrates faces an surface of electrode-supporting one of the opposite major surfaces of the other substrate. That is, the at least one electrode formed on the above-indicated other major surface of the above-indicated other substrate is interposed between the two substrates.

In the recording head of the present invention constructed as described above, the distance between the recording and return circuit electrodes as measured at the distal end of the head can be accurately controlled to a desired value, thereby assuring good contact of the electrodes with the electrically resistive layer, and permitting excellent quality of printing by the recording head, for a prolonged period of time.

The electrodes formed on the two substrates usually consist of at least one recording electrode formed on one of the two substrates, and at least one return circuit electrode. In this case, the recording electrode(s) or the return circuit electrode(s), or both of the recording and return circuit electrodes may be formed on the appropriate substrate or substrates whose wear resistance is lower than those of the electrode(s).

The recording head may further comprise a reinforcing layer for reinforcing a thin-walled distal end portion of the head which includes the distal end portion of the substrate or substrates. The substrate having the distal end portion has a recess which determines the thickness of the distal end portion, and the reinforcing layer at least partially engages the recess to reinforce the distal end portion of the head. The reinforcing layer may also function as a heat radiating layer.

Generally, the recording head has a plurality of recording electrodes, and a plurality of return circuit electrodes corresponding to the recording electrodes, or a single common return circuit electrode.

The present invention was developed based on the finding as described below.

For maintaining good electrical contact of the electrodes with the electrically resistive layer for a prolonged period of use, it is advantageous to position the electrodes relative to the substrates such that the electrodes are located upstream of the substrates in the direction of relative sliding movement of the resistive layer. In other words, it is advantageous to form the electrodes on one of the opposite major surfaces of each substrate which faces in the direction opposite to the direction of movement of the resistive layer. To this end, the two substrates bearing the electrodes are superposed on each other, according to the principle of the present invention, such that the major surfaces of the two substrates on which the electrodes are formed face in the direction opposite to the direction of movement of the resistive layer. According to this arrangement, the major surface of one of the substrates on which the electrodes are not formed faces the major surface of the other substrate on which the electrodes are formed. The present arrangement is also advantageous in that the electrode(s) formed on one substrate, whose contact with the resistive layer is inferior to that of the electrode(s) formed on the other substrate, can be positioned (together with the corresponding substrate) for good contact with the resistive layer. For example, the electrode(s) whose contact is/are relatively inferior, can be positioned nearer to the resistive layer during operation of the recording head. Alternatively, the substrate supporting the electrode(s) whose contact with the resistive layer is relatively inferior may be formed of a material whose wear resistance is higher than the other elements.

The present invention is also based on the following finding. Namely, the provision of the thin-walled distal end portion on one substrate is advantageous in accurately establishing the desired distance between the electrodes on the two substrates, as measured at the distal end of the head. More specifically, the distance between the recording and return circuit electrodes is determined by the thickness of the thin-walled distal end portion of one substrate, and the thickness of only one adhesive layer interposed between that one substrate and the electrodes on the other substrate. Since the distal end portion may be easily formed with high precision by machining the appropriate substrate, and only one adhesive layer is used between that substrate and the electrodes on the other substrate the electrode-to-electrode distance can be controlled with comparatively higher accuracy. Further, since the distal end portion of the substrate also functions as a layer for electrically insulating the electrodes on the two substrates, it is not necessary to interpose an electrically insulating layer having a small overall thickness between the two substrates. In this respect, the present recording head is relatively easy to manufacture, and has a relatively high mechanical strength.

BRIEF DESCRIPTION OF THE DRAWINGS

The above and other objects, features and advantages of the present invention will be better understood by reading the following description of presently preferred embodiments of the invention, when considered in connection with the accompanying drawings, in which.

DETAILED DESCRIPTION OF THE PREFERRED EMBODIMENTS

Figure 1:
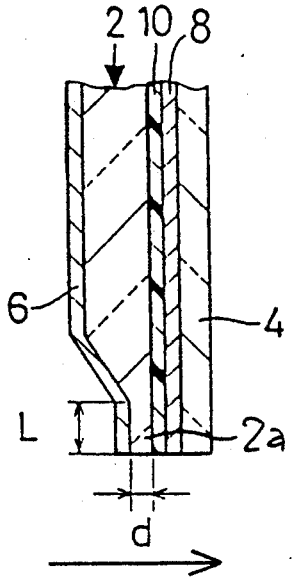
FIGS. 1–4 are fragmentary elevational views in cross section of different forms of a recording head of the present invention, taken in a plane parallel to the direction of extension of the electrodes.

Referring to FIGS. 1-4, there are shown four different forms of the recording head constructed according to the principle of the present invention, each of which has a laminar or multi-layered structure. In these figures, the same reference numerals are assigned to identify the functionally corresponding elements. In operation, a recording medium or a print ribbon or other intermediate member is moved relative to the recording head from left to right as seen FIGS. 1-4, as indicated by arrows.

In FIGS. 1-4, reference numeral 2 denotes a first substrate made of an electrically insulating material. On one of the opposite major surfaces of the first substrate 2, there is formed an array of recording electrodes 6 in the form of a multiplicity of parallel strips, which are equally spaced apart from each other in the direction perpendicular to the planes of the drawing figures. Reference numeral 4 denotes a second substrate which also has an electrically insulating property. An array of return circuit electrodes 8 in the form of multiple spaced-apart parallel strips is formed on one major surface of the second substrate 4. The first and second substrates 2, 4 having the arrays of the recording and return circuit electrodes 6, 8 are bonded together by an adhesive layer 10 such that the adhesive layer 10 is interposed between the other major surface of the first substrate 2 remote from the recording electrodes 6, and the major surface of the second substrate 4 on which the return circuit electrodes 8 are formed. Namely, the two substrates 2, 4 are superposed on each other to provide a laminar structure, such that the non-electrode bearing surface of the first substrate 2 faces the surface of the second substrate 4 which bears the return circuit electrodes 8, such that the return circuit electrodes 8 are embedded in the mass of the adhesive layer 10.

Figure 3:
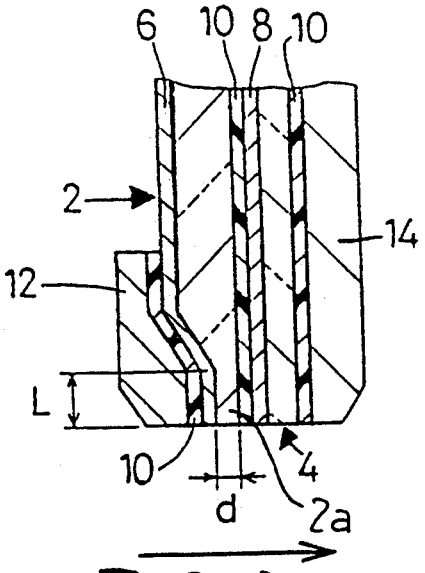
Figure 4:
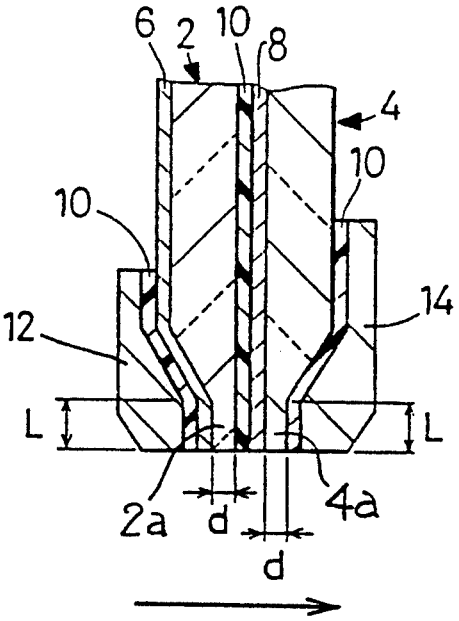

The recording heads of FIGS. 3 and 4 have a reinforcing layer 12 formed so as to cover an end portion of the major surface of the first substrate 2 on which the recording electrodes 6 are formed, and a heat-radiating layer 14 formed so as to cover an end portion of the major surface of the second substrate 4 on which the return circuit electrodes 8 are not formed. These reinforcing and heat-radiating layers 12, 14 are bonded to the respective substrates 2, 4 through respective adhesive layers 10.

In the recording heads constructed as described above, the first substrate 2 is formed of a material which is selected for good sliding contact of the electrodes 6 8 with a recording medium, or a planar intermediate support member in the form of a sheet, film or ribbon. More specifically, the substrate 2 is formed of a material which has a lower wear resistance than the material of the electrodes 6, 8. Preferably, the first substrate 2 is formed of a ceramic material which has a lower wear resistance and a lower hardness than the material of the electrodes 6, 8, and which can be easily processed or shaped with high precision. It is particularly desirable to form the substrate 2 of a ceramic material selected from the group which consists of: highly machinable glass ceramic containing mica; alumina ($Al_2O_3$) having a relatively low wear resistance; boron nitride (BN); highly machinable ceramic containing boron nitride; highly machinable glass ceramic containing boron nitride; highly machinable ceramic containing boron nitride and aluminum nitride (AlN); and highly machinable glass ceramic containing boron nitride and aluminum nitride. In particular, the highly machinable glass ceramic containing mica is preferably used.

The first substrate 2 has a proximal portion (upper portion as seen in FIGS. 1-4) which is located remote from the recording medium during operation of the head, and a thin-walled distal end portion 2a (lower portion as seen in the figures) which extends from the proximal portion by a suitable length or distance in the direction toward the recording medium, for sliding contact with the recording medium or planar intermediate support member. The thin-walled distal end portion 2a has a thickness "d" which is smaller than the thickness of the proximal portion, as measured in the direction perpendicular to the direction of extension of the distal end portion 2a from the proximal portion. The distal end portion 2a, which has the thickness "d" over a length "L", is formed by forming a recess or cutout in the end portion of one of the opposite major surfaces of the substrate 2. With the thin-walled distal end portion 2a thus formed, the recording head has a corresponding recessed distal end portion.

The thickness "d" and the length "L" of the distal end portion 2a of the first substrate 2 are suitably determined depending upon the materials of the substrate 2 and electrodes 6, 8, the required properties or characteristics of the distal end portion to be exhibited during a recording operation, and the desired force of electrical contact of the electrodes 6, 8 with the resistive layer of the recording medium or planar intermediate support member. Generally, the thickness "d" is preferably 150 μm or smaller, more preferably within a range of 25-90 μm, while the length "L" is preferably within a range of 50-4000 μm, more preferably within a range of 100-1000 μm.

The thin-walled distal end portion 2a of the first substrate may be formed by grinding, slicing or otherwise precision-machining the substrate 2, so as to provide a recess or cutout in the end portion of at least one of the opposite major surfaces of the substrate 2, so that the cutout has a desired depth depending upon the thickness "d" of the distal end portion 2a. After the distal end portion 2a is formed, the recording electrodes 6 are formed on one of the opposite major surfaces of the first substrate 2. In the case of the recording head of FIG. 2, the recording electrodes 6 are formed on the major surface of the substrate 2 which is not machined or otherwise processed for forming the distal end portion 2a. In this case, the substrate 2 may be shaped for forming the distal end portion 2a, after the electrodes 6 are formed on the substrate 2. It is also possible to initially form the substrate 2 which has the distal end portion 2a. Further, a thin-walled substrate member and a thick-walled substrate member may be bonded together to provide the substrate 2 having the thin-walled distal end portion 2a.

In the examples of FIGS. 1-4, the distal end portion 2a is provided by forming an inclined shoulder surface adjacent to the proximal end of the distal end portion 2a. The shoulder surface is inclined relative to the side surface of the distal end portion 2a having the length "L", such that these two surfaces form an obtuse angle externally of the substrate 2. However, the inclined shoulder surface may be replaced by a shoulder surface which is perpendicular to the direction of extension of the distal end portion 2a (parallel to the direction of thickness "d"), or by a rounded shoulder surface or fillet which has a suitable radius of arc and which terminates in the side surface of the distal end portion 2a.

Figure 2:
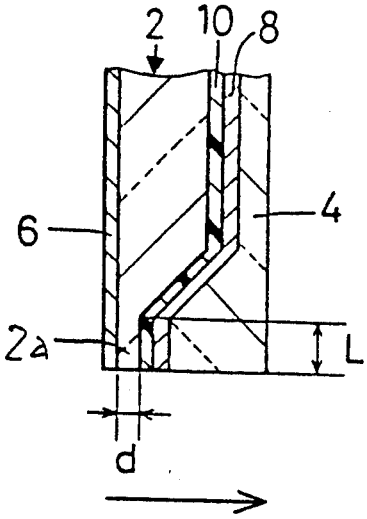

The second substrate 4 is preferably formed of a material which is the same as or similar to that of the first substrate 2, for various advantages such as reduced thermal stresses at the bonding interface between the two substrates 2, 4, and same condition of friction with respect to the electrically resistive layer of the recording medium or planar intermediate support member. For good contact of the return circuit electrodes 8 with the electrically resistive layer, the second substrate 4 is preferably formed of an element having a relatively high wear resistance selected from the low-wear resistance elements which are selected from the group consisting of: materials used for the first substrate 2 as described above; $Al_2O_3$; AlN having the thickness of 100 μm or smaller; and AlN containing BN. The thickness of the second substrate 4 is preferably 100 μm or smaller. The major surface of the second substrate 4 on which the electrodes 8 are formed corresponds in shape to the surface of the first substrate 2 on which the electrodes 6 are not formed. In the examples of FIGS. 1 and 3, the second substrate 4 has a planar shape. In the example of FIG. 2, the second substrate 4 has a thick-walled distal end portion which engages the thin-walled distal end portion 2a of the first substrate. In the example of FIG. 4, the second substrate 4 has a thin-walled distal end portion 4a similar to the distal end portion 2a.

In the recording heads of FIGS. 3 and 4, the reinforcing and heat-radiating layers 12, 14 are provided as described above. The reinforcing layer 12 is bonded with the adhesive layer 10 to the end portion of the surface of the first substrate 2 on which are formed the recording electrodes 6 and which has the cutout defining the distal end portion. This reinforcing layer 12 reinforces the thin-walled distal end portion 2a of the substrate 2, such that a portion of the reinforcing layer 12 engages the cutout formed in the distal end of the substrate 2. The heat-radiating layer 14 is bonded with another adhesive layer 10 to the surface of the second substrate 4 on which the return circuit electrodes 8 are not formed. The heat-radiating layer 14 is formed of boron nitride, aluminum nitride or other material which has a high degree of thermal conductivity.

The provision of the reinforcing layer 12 for reinforcing the thin-walled distal end portion 2a of the substrate 2 means the absence of a coating otherwise provided to cover the distal end of the recording head, which may be frictionally worn or separated from the head due to sliding contact with the recording medium or planar intermediate support member. As a result of the wearing of such coating, particles removed from the coating may be caught between the ends of the electrodes 6, 8 and the recording medium or intermediate support member, causing deterioration of the quality of printing by the recording head.

The reinforcing layer 12 provided in the recording heads of FIGS. 3 and 4 is preferably a sheet member which has lower wear resistance and hardness values than the material of the electrodes 6, 8. Particularly preferable sheet members for the reinforcing layer 12 include a highly machinable glass ceramic sheet which may or may not contain mica, a highly machinable ceramic sheet, and a metal sheet whose surface may or ma not be treated for electrical insulation. If the reinforcing layer 12 is formed from a sheet of a material having a high thermal conductivity, such as boron nitride, aluminum oxide or aluminum nitride, the reinforcing layer 12 may also function as a heat-radiating layer. If the reinforcing layer 12 is formed of the same material as that of the first substrate 2, that is, if the material of the layer 12 has the same thermal expansion coefficient as that of the substrate 2, the recording head is effectively protected from thermal stresses between the substrate 2 and the reinforcing layer 12, separation of the layer 12 from the substrate 2, or warpage or deformation of the layer 12.

The heat-radiating layer 14 bonded to the major surface of the second substrate 4 remote from the return circuit electrodes 8 is generally formed of a material similar to that of the reinforcing layer 12. The heat-radiating layer 14 functions not only to radiate heat but also to reinforce the distal end portion of the recording head. However, the heat-radiating layer 14 may be used for the sole purpose of reinforcing the head, if the reinforcing layer 12 also has a heat radiating function.

Each adhesive layer 10 used for bonding the first and second substrates 2, 4 and the reinforcing and heat-radiating layers 12, 14 may be an inorganic adhesive containing alumina, silica, boron nitride, or ther inorganic material, for example, or a resinous adhesive containing epoxy, phenol or polyimide, for example. Alternatively, the adhesive layer 10 may be a mixture of an inorganic material such as alumina, silica or boron nitride, and a resin. Among these adhesives, an inorganic adhesive containing alumina, silica, boron nitride or other inorganic material is most preferably used.

The recording electrodes 6 and return circuit electrodes 8 provided on the respective major surfaces of the first and second substrates 2, 4 are formed of an electrically conductive material which has a higher degree of wear resistance than the material of the first substrate 2 which supports the recording electrodes 6. Preferably, a major content of the electrically conductive material for the electrodes 6, 8 is selected from the group which includes: metals such as chromium, titanium, tantalum and zirconium; and compounds of these metals. These materials are advantageously used owing to their comparatively high wear resistance and comparatively low rate of consumption due to an electrical effect during use of the head. Particularly, chromium, and an alloy or a compound containing chromium are preferably used as a major component of the electrically conductive material for the electrodes 6, 8. More preferably, the electrodes are formed principally of an alloy or compound containing both chromium and nitrogen. The electrodes 6, 8 may be formed by first forming respective films of the selected electrically conductive material, by a suitable technique such as sputtering, vapor deposition, ion plating, CVD (chemical vapor deposition), coating, printing or plating, and then patterning the films into the respective arrays of the spaced-apart parallel electrode strips 6, 8, by a suitable method such as etching or lift-off method. Desirably, the electrodes 6, 8 have a thickness of at least 1 μm. If needed, the electrodes 6, 8 are plated with nickel, tin, chromium, copper, gold or other suitable metal.

Figure 5:
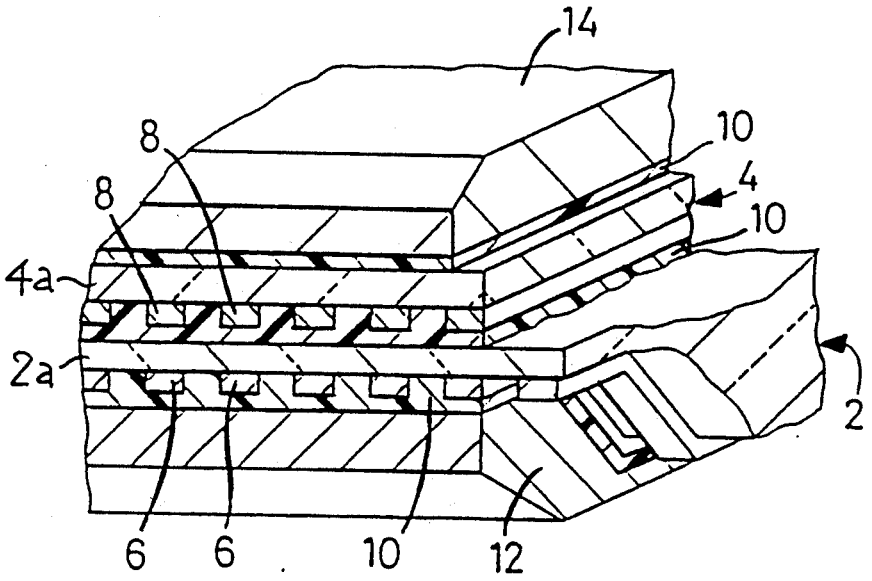
FIG. 5 is a fragmentary perspective view showing the distal end portion of the recording head of FIG. 3.
Figure 6:
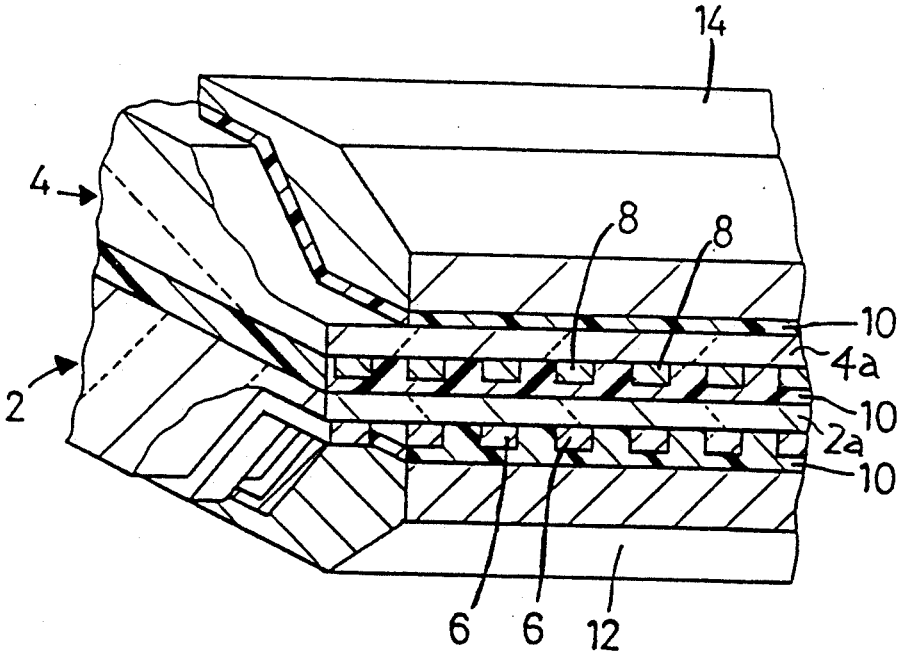
FIG. 6 is a fragmentary perspective view showing the distal end portion of the recording head of FIG. 4.

Referring to the schematic perspective views of FIGS. 5 and 6, there are illustrated recording heads whose cross sectional views of the distal end portion are given in FIGS. 3 and 4, respectively. In operation, the recording head is moved in sliding contact with the electrically resistive layer of the recording medium or intermediate support member, such that the electrically resistive layer is moved in the upward direction as seen in FIGS. 5 and 6, or in the rightward direction as seen in FIGS. 3 and 4. This direction of the relative movement of the recording head and the resistive layer is desirable for increased stability of electrical contact between the electrodes 6, 8 and the resistive layer.

The test samples of the recording heads as illustrated in FIGS. 3 and 4 (FIGS. 5 and 6) were prepared in the following manner:

The first substrate 2 was formed from a highly machinable glass ceramic sheet containing mica, and a chromium film formed by sputtering on one of the opposite major surfaces of the glass ceramic sheet was patterned by photo-etching method to form an array of spaced-apart parallel strips of chromium. These chromium strips were heat-treated in an atmosphere containing nitrogen gas and a hydrogen gas. Thus, an array of the recording electrodes 6 in the form of 480 chromium strips was formed on the first substrate 2, such that the electrode strips 6 are spaced apart from each other at a spacing pitch of 125 μm. Each electrode strip 6 has a width of 70 μm and a thickness of 6 μm. The distal end portion 2a of the substrate 2 has a thickness "d" of 70 μm, and a length "L" of 1000 μm.

The second substrate 4 used for the recording head of FIGS. 3 and 5 was prepared from a 100 μm-thick $Al_2O_3$ sheet. The substrate 4 for the recording head of FIGS. 4 and 6 was prepared from a highly machinable glass ceramic sheet containing mica, which has the same configuration as the first substrate 2. On one of the opposite major surfaces of the second substrate 4, an array of the return circuit electrodes 8 was formed in the same manner as the recording electrodes 6.

The reinforcing layer 12 was formed by machining a highly machinable glass ceramic sheet containing mica, which is similar to the glass ceramic sheet used for the first substrate 2. The heat-radiating layer 14 was formed from a boron nitride sheet (by machining the boron nitride sheet, for the layer 14 of the recording head of FIGS. 4 and 6). The thus prepared reinforcing layer 12, first and second substrates 2, 4 and heat-radiating layer 14 were superposed on each other and bonded together with an inorganic adhesive agent containing alumina, as shown in FIGS. 5 and 6, in which the adhesive agent is indicated at 10. Thus, the recording heads of FIGS. 5 and 6 each having a laminar structure were produced.

The recording heads produced as described above were tested as incorporated in a recording apparatus, such that the electrodes 6, 8 were held in sliding contact with an electrically resistive layer on an intermediate ink-bearing sheet interposed between a recording paper and the recording head, during repetitive printing cycles. The quality of the images printed by the individual recording heads was evaluated. The test revealed satisfactory results on all the test samples, namely, sufficiently high density and clearness or crispness of the printed images, and excellent contacting condition of the electrodes 6, 8 with respect to the intermediate ink-bearing sheet.

While the present invention has been described in detail in its presently preferred embodiments, it is to be understood that the invention is not limited to the details of the illustrated embodiments, but may be embodied with various changes, modifications and improvements, which may occur to those skilled in the art, without departing from the spirit and scope of the invention defined in the following claims.

What is claimed is:

1. A recording head operable to apply an electric current to an electrically resistive layer provided on a recording medium or a planar intermediate member interposed between said medium and the recording head, comprising two substrates, and at least one electrode formed on one of opposite major surfaces of each of the two substrates, said two substrates and said electrodes being adapted to be held, at a distal end of the recording head, in contact with said electrically resistive layer, wherein the improvement comprises:

at least one of said two substrates having an electrically insulating property and a lower wear resistance than said at least one electrode formed on said at least one of said two substrates;

each of said least one of said two substrates having proximal portion, and a distal end portion extending from the proximal portion by a predetermined distance from the proximal portion for contact with said electrically resistive layer, said distal end portion having a thickness smaller than that of said proximal portion, as measured in a direction perpendicular to a direction of extension of said distal end portion; and said two substrates being superposed on each other such that a non-electrode-supporting one of said opposite major surfaces of one of said two substrates faces an electrode-supporting on of said opposite major surfaces of the other substrate.

2. A recording head according to claim 1, wherein said at least one electrode formed on one of said two substrates consists of at least one recording electrode, while said at least one electrode formed on the other of said two substrates consists of at least one return circuit electrode, said two substrates being formed of respective materials having a lower wear resistance than those of said recording and return circuit electrodes.

3. A recording head according to claim 1, further comprising a reinforcing layer for reinforcing a thin-walled distal end portion of the head which includes said distal end portion of said at least one of said two substrates, each of said at least one substrate having a recess which determines said thickness of said distal end portion, said reinforcing layer at least partially engaging said recess.

4. A recording head according to claim 1, wherein the thickness of said distal end portion is 150 μm or smaller.

5. A recording head according to claim 4, wherein the thickness of said distal end portion is within a range of 25–90 μm.

6. A recording head according to claim 1, wherein the length of said distal end portion is within a range of 50–4000 μm.

7. A recording head according to claim 6, wherein the length of said distal end portion is within a range of 100–1000 μm.

8. A recording head according to claim 1, wherein each of said at least one of the two substrates which has a lower wear resistance is formed of a material selected from the group consisting of: highly machinable glass ceramic containing mica; alumina having a relatively low wear resistance; boron nitride; highly machinable ceramic containing boron nitride; highly machinable glass ceramic containing boron nitride; highly machinable ceramic containing boron nitride and aluminum nitride; and highly machinable glass ceramic containing boron nitride and aluminum nitride.

9. A recording head according to claim 1, wherein said at least one electrode formed on each of the two substrates is formed of an electrically conductive material whose major component consists of a metal containing at least one material selected from the group consisting of chromium, titanium, tantalum and zirconium, or a compound thereof.

10. A recording head according to claim 1, wherein both of said two substrates have said distal end portion.

11. A recording head operable to apply an electric current to an electrically resistive layer provided on a recording medium or a planar intermediate member interposed between said medium and the recording head, comprising two substrates, and at least one electrode formed on one of opposite major surfaces of each of the two substrates, said two substrates and said electrodes being adapted to be held, at a distal end of the recording head, in contact with said electrically resistive layer, wherein the improvement comprises:

at least one of said two substrates being electrically insulating and having a lower wear resistance than said at least one electrode formed on said at least one of said two substrates;

said two substrates being superposed on each other such that a non-electrode-supporting surface on one of said opposite major surfaces of one of said two substrates faces an electrode-supporting surface of one of said opposite major surfaces of the other substrate; and at least one of said two substrates having a proximal portion, and a distal end portion extending a predetermined distance from the proximal portion, said distal end portion being adapted for contact with said electrically resistive layer, said distal end portion having a thickness, between said electrodes, smaller than that of said proximal portion.

* * * * *